US010619524B2

(12) United States Patent
Olovsson et al.

(10) Patent No.: US 10,619,524 B2
(45) Date of Patent: Apr. 14, 2020

(54) VARIABLE CAM TIMING PHASER UTILIZING HYDRAULIC LOGIC ELEMENT

(71) Applicant: Scania CV AB, Södertälje (SE)

(72) Inventors: Daniel Olovsson, Södertälje (SE); Mikael Eriksson, Torslanda (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 16/306,660

(22) PCT Filed: May 10, 2017

(86) PCT No.: PCT/SE2017/050467
§ 371 (c)(1),
(2) Date: Dec. 3, 2018

(87) PCT Pub. No.: WO2017/213568
PCT Pub. Date: Dec. 14, 2017

(65) Prior Publication Data

US 2019/0170030 A1 Jun. 6, 2019

(30) Foreign Application Priority Data

Jun. 8, 2016 (SE) ..... 1650796

(51) Int. Cl.
*F01L 1/344* (2006.01)

(52) U.S. Cl.
CPC ..... *F01L 1/34409* (2013.01); *F01L 1/3442* (2013.01); *F01L 2001/34426* (2013.01); *F01L 2001/34483* (2013.01)

(58) Field of Classification Search
CPC ..... F01L 1/34409; F01L 1/3442; F01L 2001/34423; F01L 2001/34426; F01L 2001/3443; F01L 2001/34433
(Continued)

(56) References Cited

U.S. PATENT DOCUMENTS 5,056,477 A 10/1991 Linder et al.
5,649,506 A 7/1997 Melchior
(Continued)

FOREIGN PATENT DOCUMENTS

DE 3930157 A1 3/1991
DE 202004021243 U1 4/2007
(Continued)

OTHER PUBLICATIONS

Scania CV AB, International Application No. PCT/SE2017/050467, International Preliminary Report on Patentability, dated Dec. 11, 2018.
(Continued)

*Primary Examiner* — Jorge L Leon, Jr.
(74) *Attorney, Agent, or Firm* — Moore & Van Allen PLLC; W. Kevin Ransom

(57) ABSTRACT

A variable cam timing phaser arrangement is disclosed, comprising: a rotor having at least one vane; a stator co-axially surrounding the rotor, having at least one recess for receiving the at least one vane of the rotor, wherein the at least one vane divides the at least one recess into a first chamber and a second chamber; and a control assembly for regulating hydraulic fluid flow from the first chamber to the second chamber or vice-versa. The control assembly comprises a cam torque actuation control valve comprising a valve body and a hydraulic shuttle element. The HSE shuttles between two positions in response to overpressure in the first or second chamber, which prevents flow between the chambers. Deploying a blocking device blocks the HSE from attaining one of the two positions, thereby allowing unidirectional flow between the two chambers. By timing the deployment of the blocking device, the direction of flow can be controlled.

15 Claims, 7 Drawing Sheets

(58) Field of Classification Search
USPC ..... 123/90.15, 90.17
See application file for complete search history.

(56) References Cited

U.S. PATENT DOCUMENTS

| | | | | |
|---|---|---|---|---|
| 7,000,580 | B1* | 2/2006 | Smith | F01L 1/3442 123/90.15 |
| 7,311,069 | B2 | 12/2007 | Kobayashi et al. | |
| 2002/0088413 | A1 | 7/2002 | Smith et al. | |
| 2004/0182344 | A1 | 9/2004 | Simpson et al. | |
| 2005/0028771 | A1* | 2/2005 | Jiang | F01L 1/3442 123/90.17 |
| 2005/0103293 | A1 | 5/2005 | Lancefield | |
| 2007/0017463 | A1 | 1/2007 | Mott et al. | |
| 2007/0028874 | A1 | 2/2007 | Simpson | |
| 2007/0039581 | A1 | 2/2007 | Berndorfer | |
| 2008/0135004 | A1 | 6/2008 | Simpson et al. | |
| 2009/0071140 | A1 | 3/2009 | Knecht et al. | |
| 2009/0178635 | A1 | 7/2009 | Takenaka | |
| 2013/0139916 | A1* | 6/2013 | Miyachi | F01M 1/16 137/565.01 |
| 2013/0199478 | A1* | 8/2013 | Tanaka | F01L 1/3442 123/90.17 |
| 2013/0220253 | A1 | 8/2013 | Pluta et al. | |
| 2013/0291835 | A1* | 11/2013 | Imamura | F02D 13/02 123/445 |
| 2014/0102392 | A1 | 4/2014 | Busse | |
| 2014/0251247 | A1 | 9/2014 | Tewes et al. | |
| 2014/0261266 | A1* | 9/2014 | Wigsten | F01M 9/10 123/90.17 |
| 2016/0024980 | A1* | 1/2016 | Sakata | F01L 1/3442 123/90.17 |
| 2016/0053640 | A1 | 2/2016 | Schafer et al. | |
| 2016/0108774 | A1* | 4/2016 | Pietrzyk | F01L 1/3442 123/90.1 |

FOREIGN PATENT DOCUMENTS

| | | | |
|---|---|---|---|
| DE | 102008001801 | A1 | 11/2009 |
| DE | 102008002461 | A1 | 12/2009 |
| DE | 102011055651 | A1 | 5/2013 |
| DE | 102013207616 | A1 | 10/2014 |
| DE | 102014218547 | A1 | 3/2016 |
| EP | 1522684 | A2 | 4/2005 |
| EP | 1598528 | A2 | 11/2005 |
| WO | WO2006069156 | A1 | 6/2006 |
| WO | WO2006127347 | A1 | 11/2006 |
| WO | WO2006127348 | A1 | 11/2006 |
| WO | WO2012061233 | A2 | 5/2012 |
| WO | WO2014173399 | | 5/2012 |

OTHER PUBLICATIONS

International Search Report for International Patent Application No. PCT/SE2017050468 dated Aug. 31, 2017.

Written Opinion of the International Searching Authority for International Patent Application No. PCT/SE2017050468 dated Aug. 31, 2017.

* cited by examiner

VARIABLE CAM TIMING PHASER UTILIZING HYDRAULIC LOGIC ELEMENT

CROSS-REFERENCE TO RELATED APPLICATIONS

This application is a national stage application (filed under 35 § U.S.C. 371) of PCT/SE2017/050467, filed May 10, 2017 of the same title, which, in turn, claims priority to Swedish Application No. 1650796-4 filed Jun. 8, 2016; the contents of each of which are hereby incorporated by reference.

FIELD OF THE INVENTION

The present invention concerns a variable cam timing phaser arrangement for an internal combustion engine as well as a method for controlling the timing of a camshaft in an internal combustion engine using such a variable cam timing phaser. The invention also concerns an internal combustion engine and a vehicle comprising such a variable cam timing phaser arrangement.

BACKGROUND OF THE INVENTION

The valves in internal combustion engines are used to regulate the flow of intake and exhaust gases into the engine cylinders. The opening and closing of the intake and exhaust valves in an internal combustion engine is normally driven by one or more camshafts. Since the valves control the flow of air into the engine cylinders and exhaust out of the engine cylinders, it is crucial that they open and close at the appropriate time during each stroke of the cylinder piston. For this reason, each camshaft is driven by the crankshaft, often via a timing belt or timing chain. However, the optimal valve timing varies depends on a number of factors, such as engine load. In a traditional camshaft arrangement the valve timing is fixedly determined by the relation of the camshaft and crankshaft and therefore the timing is not optimized over the entire engine operating range, leading to impaired performance, lower fuel economy and/or greater emissions. Therefore, methods of varying the valve timing depending on engine conditions have been developed.

One such method is hydraulic variable cam phasing (hVCP). hVCP is one of the most effective strategies for improving overall engine performance by allowing continuous and broad settings for engine-valve overlap and timing. It has therefore become a commonly used technique in modern compression-ignition and spark-ignition engines.

Both oil-pressure actuated and cam torque actuated hydraulic variable cam phasers are known in the art.

The oil-pressure actuated hVCP design comprises a rotor and a stator mounted to the camshaft and cam sprocket respectively. Hydraulic oil is fed to the rotor via an oil control valve. When phasing is initiated, the oil control valve is positioned to direct oil flow either to an advance chamber formed between the rotor and stator, or a retard chamber formed between the rotor and stator. The resulting difference in oil pressure between the advance chamber and the retard chamber makes the rotor rotate relative to the stator. This either advances or retards the timing of the camshaft, depending on the chosen position of the oil control valve.

The oil control valve is a three-positional spool valve that can be positioned either centrally, i.e. co-axially with the camshaft, or remotely, i.e. as a non-rotating component of the hVCP arrangement. This oil control valve is regulated by a variable force solenoid (VFS), which is stationary in relation to the rotating cam phaser (when the oil control valve is centrally mounted). The variable force solenoid and the spool valve have three operational positions: one to provide oil to the advance chamber, one to provide oil to the retard chamber, and one to refill oil to both chambers (i.e. a holding position).

The established oil pressure actuated hVCP technology is effective in varying valve timing, but has relatively slow phasing velocities and high oil consumption. Therefore, the latest iterations of hVCP technology utilize a technique known as cam torque actuation (CTA). As the camshaft rotates the torque on the camshaft varies periodically between positive torque and negative torque in a sinusoidal manner. The exact period, magnitude and shape of the cam torque variation depends on a number of factors including the number of valves regulated by the camshaft and the engine rotation frequency. Positive torque resists cam rotation, while negative cam torque aids cam rotation. Cam torque actuated phasers utilize these periodic torque variations to rotate the rotor in the chosen direction, thereby advancing or retarding the camshaft timing. In principle they operate as "hydraulic ratchets", allowing fluid to flow in a single direction from one chamber to the other chamber due to the torque acting on the oil in the chambers and causing periodic pressure fluctuations. The reverse direction of fluid flow is prevented by check valve. Therefore, the rotor will be rotationally shifted relative to the stator every period the torque acts in the relevant direction, but will remain stationary when the torque periodically acts in the opposite direction. In this manner, rotor can be rotated relative to the stator, and the timing of the camshaft can be advanced or retarded.

Cam torque actuation systems therefore require check valves to be placed inside the rotor in order to achieve the "hydraulic ratchet" effect. The directing of oil flow to the advance chamber, retard chamber, or both/neither (in a holding position) is typically achieved using a three-positional spool valve. This spool valve can be positioned either centrally, i.e. co-axially with the camshaft, or remotely, i.e. as a non-rotating component of the cam phasing arrangement. The three-positional spool valve is typically moved to each of the three operative positions using a variable force solenoid.

Patent application US 2008/0135004 describes a phaser including a housing, a rotor, a phaser control valve (spool) and a regulated pressure control system (RCPS). The phaser may a cam torque actuated phaser or an oil pressure activated phaser. The RPCS has a controller which provides a set point, a desired angle and a signal bases on engine parameters to a direct control pressure regulator valve. The direct control pressure regulator valve regulates a supply pressure to a control pressure. The control pressure moves the phaser control spool to one of three positions, advance, retard and null, in proportion to the pressure supplied.

There remains a need for improved cam timing phaser arrangements. In particular, there remains a need for cam timing phaser arrangements that are suitable for use commercial vehicles, which are often subject to heavier engine loads and longer service lives as compared to passenger cars.

SUMMARY OF THE INVENTION

The inventors of the present invention have identified a range of shortcomings in the prior art, especially in relation to the use of existing cam phaser arrangements in commercial vehicles. It has been found that the three-positional spool valves of the oil control valve (OCV) in present systems must be precisely regulated and therefore are sensitive to impurities that may jam the spool in a single position. Due to the need for three-position regulation, the solenoids or pressure regulators used in conjunction with the oil control valve must be able to be precisely regulated to provide varying force, in order to attain three positions. This adds considerable mechanical complexity to the system, making it more expensive, more sensitive to impurities and less robust. It also makes the routines for controlling the cam phaser more complex.

It has been observed that that when the oil control valve is solenoid-actuated and centrally mounted the contact between the solenoid-pin and the oil control valve is non-stationary since the oil control valve rotates and the solenoid-pin is stationary. This sliding-contact wears the contact surfaces and the position accuracy of the oil control valve is compromised over the long-term which affects the cam phaser performance. The accuracy of the variable force solenoid itself must also remain high to ensure precise control over the OCV.

Further, oil leakage of existing cam phaser arrangements is also a problem. Cross-port leakage inside the oil control valve cause oil to escape the hydraulic circuit and increase camshaft oscillations due to decreased system stiffness. This leakage also affects the oil consumption of the cam phaser arrangement. It has been observed that the three-positional spool valves used in regulating oil flow offer many different leakage paths for oil to escape the cam phaser chambers. Most noticeable is the sliding contact surface closest to the variable force solenoid where the valve is solenoid-actuated, as well as the port connected to vent. This leakage increases with increased pressure inside the cam phaser chambers since all the pressure spikes in the system must be absorbed by the oil control valve. These pressure spikes are in turn dependent on camshaft torque and may exceed 50 bars for commercial vehicles. Camshaft torques are higher in heavy-duty vehicles, causing higher pressure spikes and even more leakage.

It has been observed that existing cam phasing systems utilising remotely-mounted oil control valves suffer from even greater system leakage because the pressure spikes from the cam phaser must be transmitted through the camshaft journal bearing before reaching the oil control valve, therefore increasing bearing leakage.

Further, it has been found that the rotor of existing cam torque actuated phasing systems is very compact and complex. Specially-designed check valves must be mounted in the rotor in order to fit in conjunction with the oil control valve. Such check valves are less durable than conventional check valves and add additional expense. Moreover, the rotor requires a complex internal hydraulic pipe system. Due to these requirements, the manufacturing of cam torque actuated cam phasers requires special tools and assembling.

Thus, it is an object of the present invention to provide a variable cam timing phaser arrangement utilizing cam torque actuation that is mechanically simpler, more robust and less prone to oil leakage than known cam torque actuated cam phasers.

This object is achieved by the variable cam timing phaser arrangement according to the appended claims.

The variable cam timing phaser arrangement comprises:

a rotor having at least one vane, the rotor arranged to be connected to a camshaft;

a stator co-axially surrounding the rotor, having at least one recess for receiving the at least one vane of the rotor and allowing rotational movement of the rotor with respect to the stator, the stator having an outer circumference arranged for accepting drive force;

wherein the at least one vane divides the at least one recess into a first chamber and a second chamber, the first chamber and the second chamber being arranged to receive hydraulic fluid under pressure, wherein the introduction of hydraulic fluid into the first chamber causes the rotor to move in a first rotational direction relative to the stator and the introduction of hydraulic fluid into the second chamber causes the rotor to move in a second rotational direction relative to the stator, the second rotational direction being opposite the first rotational direction; and a control assembly for regulating hydraulic fluid flow from the first chamber to the second chamber or vice-versa;

characterized in that the control assembly comprises:

a cam torque actuation (CTA) control valve located centrally within the rotor and/or camshaft, the CTA control valve comprising a valve body having a first port arranged in fluid communication with the first chamber, a second port arranged in fluid communication with the second chamber, and a hydraulic shuttle element arranged in the valve body; and a blocking device arranged in conjunction with the valve body;

wherein the hydraulic shuttle element is configured to be moved in a first direction to a first closed position by overpressure in the first chamber and moved in the second direction to a second closed position by overpressure in the second chamber;

whereby in the first closed position the hydraulic shuttle element forms a seal together with an inner wall of the valve body or a valve seat located in the valve body, thereby preventing fluid flow from the first chamber to the second chamber; and whereby in the second closed position the hydraulic shuttle element forms a seal together with an inner wall of the valve body or a valve seat located in the valve body, thereby preventing fluid flow from the second chamber to the first chamber; and wherein the blocking device comprises at least one blocking element that is deployable between a disengaged position and an engaged position, wherein the at least one blocking element is in the engaged position configured to prevent the hydraulic shuttle from moving to the first closed position or the second closed position depending on the position of the hydraulic shuttle element when the blocking device is deployed, whereby the hydraulic shuttle element is configured to move either between the first closed position in response to overpressure in the first chamber and a second open position in response to overpressure in the second chamber, or between the second closed position in response to overpressure in the second chamber and a first open position in response to overpressure in the first chamber;

whereby in the second open position the hydraulic shuttle element allows fluid flow from the second chamber to the first chamber; and whereby in the first open position the hydraulic shuttle element allows fluid flow from the first chamber to the second chamber.

The variable cam timing phaser arrangement described can be used to provide cam phasing by timing the deployment of the blocking device to allow directional fluid flow from one of the chambers to the other, in the desired direction, while preventing flow in the opposite undesired direction.

A variable cam timing phaser arrangement constructed in this manner has a number of advantages. It is constructionally simple, requiring only a single simple on/off valve or solenoid to control to cam phaser. The cam phaser is more robust due to less complex and/or less sensitive hydraulic components compared to other cam torque actuated cam phasers. The use of only constructionally robust on/off actuation and the avoidance of transferral of pressure spikes through the camshaft bearings means that oil escape paths are fewer and oil consumption lower. The risk of valves or solenoids jamming is lowered since any actuating valves or solenoids used need take only two positions, i.e. on/off, meaning that a greater actuating force and/or stronger return mechanisms can be used. More robust solenoids can be used since intermediate position accuracy is not needed. Similarly, no fine multi-pressure regulation is needed to actuate the blocking device. Check-valves can be mounted externally to the cam phaser (i.e. not in the rotor vanes), thus allowing the use of more established and robust check valves. A further advantage is that the rotor component bears a greater similarity to oil-actuated cam phasers which are cheaper to manufacture than known cam torque actuated cam phasers.

The hydraulic shuttle element is arranged to move by translational motion along a longitudinal axis of the valve body in response to pressure differences between the first chamber and the second chamber. This allows the CTA control valve to be constructed from conventional valve elements such as disc or ball valve members and corresponding valve seats. Thus, well established, robust components may be used.

The CTA control valve may comprise a valve body having the first port arranged at a first end of the valve body and the second port arranged at a second end of the valve body, wherein a first valve seat is arranged in the valve body between the first end and a middle portion of the body, and a second valve seat is arranged in the valve body between the middle portion of the body and the second end. Such a CTA control valve may comprise a hydraulic shuttle element comprising a first valve member arranged between the first end and the first valve seat, and arranged to be able to form a seal with the first valve seat, a second valve member arranged between the second valve seat and the second end and arranged to be able to form a seal with the second valve seat, and a valve stem passing through the first valve seat and second valve seat and arranged to attach the first valve member to the second valve member, wherein the valve stem has a length such that when the first valve member forms a seal with the first valve seat the second valve member cannot be seated on the second valve seat, and vice-versa when the second valve member forms a seal with the second valve seat the first valve member cannot be seated on the first valve seat.

A CTA control valve formed in this manner resembles two check valves coupled in series and facing in opposite directions, wherein the valve member of one check valve is attached to the other, so that the action of one valve member affects the other valve member. Since check valves are well-established reliable technology, a CTA control valve based on such check valves should also prove robust and reliable.

The blocking device may a blocking device comprising:

a cylinder having a first end in fluid communication with the first chamber and a second end in fluid communication with the second chamber;

a cylinder member arranged in the cylinder and arranged to be moveable in a direction along a longitudinal axis of the cylinder between a first cylinder position by fluid pressure whenever the hydraulic shuttle element is in a first closed position, and a second cylinder position by fluid pressure whenever the hydraulic shuttle element is in a second closed position, wherein the cylinder member is arranged to be moveable in a radial direction relative to the longitudinal axis of the cylinder when in the first cylinder position or second cylinder position whenever the blocking device is deployed;

a first blocking element arranged to be moveable to an engaged position by the radial motion of the cylinder member whenever the blocking device is deployed with the cylinder member in the second position, wherein the engaged position blocks the hydraulic shuttle element from attaining the first closed position; and a second blocking element arranged to be moveable to an engaged position by the radial motion of the cylinder member whenever the blocking device is deployed with the cylinder member in the first position, wherein the engaged position blocks the hydraulic shuttle element from attaining the second closed position.

Such a blocking device operates by moving a cylinder member, such as a piston or ball, along the length of a cylinder using fluid pressure. This provides an effective mode of selectively blocking a single closed position of the hydraulic shuttle element while allowing the other closed position, thus obtaining unidirectional flow in the desired direction.

The hydraulic shuttle element may be arranged to move by rotational motion around a central rotational axis of the valve body in response to pressure differences between the first chamber and the second chamber. Thus, the CTA control valve may resemble a cam phaser rotor-stator arrangement in miniature, allowing many of the same principles and manufacturing techniques to be applied.

The hydraulic shuttle element may comprise two or more hollows arranged to receive the at least one blocking element when engaged. Thus, by forming the shuttle element in this manner, only a single blocking element is needed and therefore there is no need for an arrangement for selectively deploying one of two blocking elements. Thus, the overall design of the CTA control valve is simplified and fewer moving parts are used.

The at least one blocking element may be deployed by increased external hydraulic pressure, by increased external pneumatic pressure, or by energization of a solenoid. Thus, a wide variety of techniques, including remote actuation, may be used in actuating the CTA control valve.

The at least one blocking element may be deployed by increased external hydraulic pressure and the external hydraulic pressure may be regulated by a solenoid-controlled actuator located remotely from any rotating components of the cam timing phaser arrangement. Thus, the use of a bulky central solenoid as avoided and space may be be saved at appropriate locations within the internal combustion engine by relocating the actuator to where space is available. The solenoid-controlled actuator may be a 3/2 way on/off solenoid valve having an inlet port in fluid communication with a source of increased fluid pressure an outlet port in fluid communication with the blocking device, and a vent port, wherein the primary state of the solenoid valve is a de-energized state preventing fluid communication from the source of increased fluid pressure to blocking device and allowing fluid communication from the blocking device to the vent port, and wherein the secondary state of the solenoid valve is an energized state allowing fluid communication from the source of increased fluid pressure to the blocking device and deploying the at least one blocking element. Such solenoid valves are readily-available, well-established and sufficiently robust to provide reliable service in commercial and heavy vehicle applications. The solenoid valve may be of the poppet-type, which virtually eliminates the risk for valve jam.

The solenoid-controlled actuator may comprise a solenoid-driven plunger arranged in a barrel, the barrel being arranged in fluid communication with the blocking device, wherein the primary state of the solenoid-driven plunger is a retracted de-energized state and the secondary state of the solenoid-driven plunger is an extended energized state, the extended state increasing the pressure of the fluid at the blocking device and deploying the at least one blocking element. Thus the actuation pressure of the piloted valve need not be dependent on the system oil pressure of the vehicle. Utilising a cylinder actuator, the actuation pressure can be designed to be higher than the oil system pressure, or lower, if desired. This allows for greater system robustness.

A source of increased fluid pressure may be arranged in fluid communication with the first chamber and/or the second chamber via a refill channel. Thus, the fluid pressure in the cam phaser arrangement can be maintained at an appropriate level, appropriate stiffness is achieved, and camshaft vibration can be minimized.

The hydraulic fluid may be hydraulic oil. The use of hydraulic oil in camshaft phaser arrangements is well-established and reliable.

According to another aspect of the invention, a method for controlling the timing of a camshaft in an internal combustion engine comprising a variable cam timing phaser arrangement as described above is provided. The method comprising the steps:

i. Providing the variable cam timing phaser arrangement having the blocking device in a disengaged position, thereby preventing fluid communication between the first chamber and the second chamber;

ii. Deploying the blocking device at a time to coincide with the hydraulic shuttle element being in the first position thereby engaging the at least one blocking element to block the second position; or deploying the blocking device at a time to coincide with the hydraulic shuttle element being in the second position thereby engaging the at least one blocking element to block the first position;

iii. Maintaining the deployment of the blocking device thereby allowing fluid to periodically flow in a single direction between the first chamber and the second chamber due to camshaft torque, and preventing fluid flow in the opposite direction, thus rotating the rotor relative to the stator in a chosen direction;

iv. Once the desired rotation of the rotor relative to the stator is obtained, disengaging the blocking device, thereby preventing further fluid communication between the first chamber and the second chamber.

This method provides a simple, reliable way of controlling camshaft phasing, requiring control of only a single on/off actuator and requiring only a single simple timing of the actuation when initiating phasing in a desired direction.

According to a further aspect, an internal combustion engine comprising a variable cam timing phaser arrangement as described above is provided.

According to yet another aspect, a vehicle comprising a variable cam timing phaser arrangement as described above is provided.

Further aspects, objects and advantages are defined in the detailed description below with reference to the appended drawings.

BRIEF DESCRIPTION OF THE DRAWINGS

For the understanding of the present invention and further objects and advantages of it, the detailed description set out below can be read together with the accompanying drawings, in which the same reference notations denote similar items in the various diagrams, and in which.

DETAILED DESCRIPTION OF THE INVENTION

Figure 1:
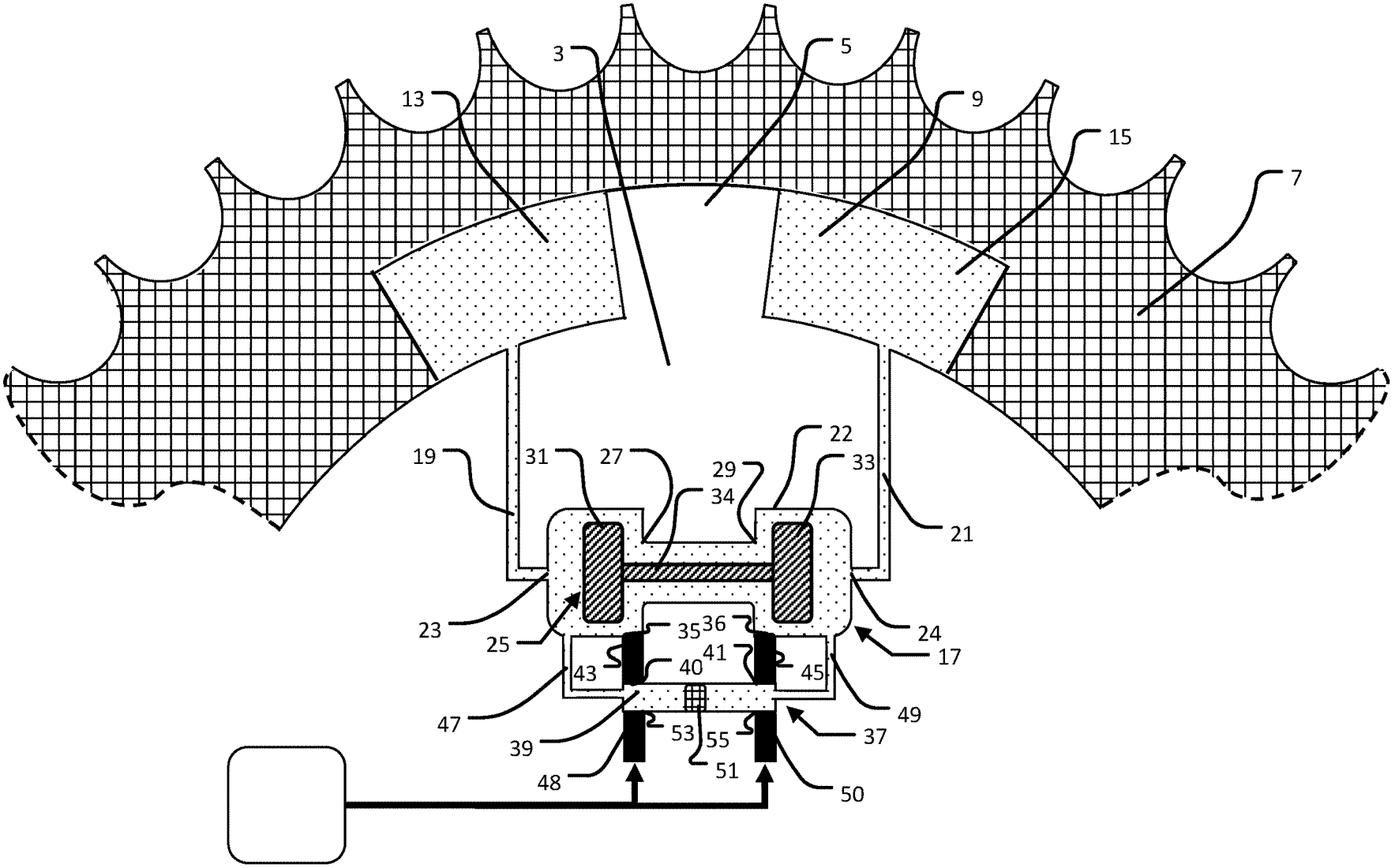
FIG. 1 illustrates schematically one embodiment of a variable cam timing phaser arrangement according to the present disclosure.

The present invention is based on the realization that a valve comprising a valve member ("hydraulic shuttle element") that is passively moved in response to a pressure difference over the first and second chambers of a cam phaser can be used to control cam torque actuated cam phasing in both directions.

The torque experienced by a camshaft alternates periodically between a positive torque, which retards camshaft rotation, and a negative torque, which abets camshaft rotation. This periodically alternating torque in turn leads to a periodically alternating pressure difference between the first chamber and the second chamber, so that initially there is overpressure in the first chamber, then in the second chamber, then in the first chamber, then in the second chamber, and so on and so forth. If the two chambers are in fluid communication, fluid will flow from the higher pressure chamber to the lower pressure chamber, i.e. the direction of flow will periodically alternate. Conventional cam torque actuated (CTA) cam phasers utilize this alternating pressure by providing two separate unidirectional flow paths between the first chamber and the second chamber: a first path allowing only flow from the first chamber to the second chamber, and a second path allowing only flow in the opposite direction, i.e. from the second chamber to the first chamber. By opening one of these flow paths while closing the other, the alternating pressure difference results in unidirectional flow from one chamber to the other by a "hydraulic ratchet" effect.

The cam timing phaser arrangement of the present invention comprises a rotor, a stator co-axially surrounding the rotor, and a control assembly.

The cam phaser rotor is arranged to be connected to a camshaft of the internal combustion engine. This can be an intake valve camshaft, exhaust valve camshaft, or any other camshaft in the engine such as a combined intake/exhaust camshaft. The rotor has at least one vane, but may preferably have a plurality of vanes, such as three, four, five or six vanes. Separate oil channels for channelling oil to and from the piloted valve of the control assembly are provided at each side of at least one of the vanes, but preferably at each side of each of the vanes.

The stator is arranged for accepting drive force. This may for example be by connecting the stator to a cam sprocket, which takes up drive force from the crankshaft via the timing belt. The stator may also be constructionally integrated with the cam sprocket. The stator co-axially surrounds the rotor and has at least one recess for accepting the at least one vane of the rotor. In practice, the stator has the same number of recesses as the number of rotor vanes. The recesses in the stator are somewhat larger than the rotor vanes, meaning that when the rotor is positioned in the stator with the vanes centrally positioned in the recesses, a chamber is formed at each side of each rotor. These chambers can be characterized as first chambers, rotating the rotor in a first direction relative to the stator when filled with hydraulic oil, and second chambers, rotating the rotor in a second direction relative to the stator when filled with hydraulic oil.

The control assembly of the present disclosure comprises a cam torque actuation (CTA) control valve and a blocking device arranged in conjunction with the valve body.

Where valves are referred to as "on/off" this refers to a valve having only two states: an open state and a closed state. Such valves may however have more than two ports. For example, a 3/2 way on/off valve has three ports and two states. Such a valve often connects two flow ports when open and connects one of the flow ports to a vent/exhaust port when closed.

Where valves are referred to as "normally closed/open/on/off", this refers to the state of the valve when non-actuated. For example, a normally open solenoid valve is held in the open position when not actuated/energized, commonly using a return such as a spring return. When the normally open solenoid valve is actuated/energized the solenoid acts with a force sufficient to overcome the force of the return holding the valve open, and the valve is therefore closed. Upon de-actuation/de-energization, the return returns the valve to the open state.

Where components are stated to be in "fluid communication" or flow is allowed or prevented "between" components, this flow is to be interpreted as not necessarily directional, i.e. flow may proceed in either direction. Directional flow in a single direction is denoted as flow "from" a component "to" another component.

Where a said chamber is referred to as having overpressure, this means that the fluid pressure in the said chamber is higher than the fluid pressure in the other chamber. For instance, if the first chamber is stated to have overpressure, this means that the pressure in the first chamber is higher than in the second chamber.

The CTA control valve is located centrally within the rotor and/or camshaft of the cam phaser arrangement and comprises a valve body having a first port arranged in fluid communication with the first chamber, a second port arranged in fluid communication with the second chamber, and a hydraulic shuttle element arranged in the valve body.

The CTA control valve operates on the principle that the hydraulic shuttle element when moving unhindered in the valve body is pressed back and forth between two closed positions by the periodically alternating pressure difference. At the same time, the hydraulic shuttle element acts as a check valve member when in each closed position, preventing flow in the direction that the pressure difference is acting in. Thus, when unhindered, the hydraulic shuttle element senses the pressure fluctuations and is moved back and forward between two closed positions by them, but does not allow fluid communication between the two chambers since it acts as a check valve in both flow directions.

The hydraulic shuttle element may be positioned coaxially to the valve housing and rotate around the common axis. A hydraulic shuttle element operating in this manner may for example be a rotating disc, whereby the shuttle element and valve body together form a rotor-stator-like arrangement. The hydraulic shuttle may move in a linear manner along a longitudinal axis of the valve housing or an axis transverse to the longitudinal axis. A shuttle element operating in this manner may for example comprise of two valve members connected by a valve stem in a "dumbbell" arrangement. Such valve members may for example be ball valve members of disc valve members.

The check valve function of the CTA valve may be obtained in any number of ways. If the hydraulic shuttle element moves in a linear manner, flow may be prevented by a valve member of the shuttle element being pressed in sealing engagement against a valve seat or valve wall by fluid pressure on the side of the chamber with overpressure. If the hydraulic shuttle element utilizes rotational motion, flow may be prevented by the shuttle element rotating to close a flow channel in the valve body.

In order to allow cam phasing the unhindered motion of the hydraulic shuttle element is blocked to prevent the hydraulic shuttle element from attaining one of the closed positions; i.e. in one direction of movement the hydraulic shuttle element is limited to an intermediate position, whereas in the other direction it can still attain the closed position. The hydraulic shuttle element is still responsive to the pressure difference between the first and second chamber, but is now moved between a closed position and an open position. In the open position the hydraulic shuttle element cannot act as a check valve member and therefore allows fluid communication between the first chamber and the second chamber. Thus, when the pressure difference acts in one direction fluid flow is allowed by the hydraulic shuttle element, whereas in the other direction fluid flow is prevented by the hydraulic shuttle element. Thus, the CTA valve having a blocked hydraulic shuttle element acts as a "hydraulic ratchet" in a single direction.

The direction that the CTA valve allows flow, and therefore the direction of cam phasing, is determined by the position of the hydraulic shuttle element when it is initially blocked. If it is in the first closed position when blocked, it will alternate between the first closed position and the second open position; i.e. the second closed position is blocked. Alternatively, if it is in the second closed position when blocked, it will alternate between the second closed position and the first open position; i.e. the first closed position is blocked. Thus, the direction of cam phasing can be chosen by timing the blocking of the hydraulic shuttle element to coincide with the hydraulic shuttle element being either in the first closed position or the second closed position. Notice that it is the opposing closed position to the current position of the hydraulic shuttle element that is blocked. This means that initiation of blocking should be timed to coincide with a pressure difference acting in the opposite direction to the direction of cam phasing desired. The pressures generated by camshaft torque are large and the hydraulic shuttle is easily moveable, and therefore shuttling between positions is momentary. Since the camshaft torque varies periodically with the crank angle and shuttling is rapid, the shuttle position also varies with crank angle and the blocking of the hydraulic shuttle element is therefore simple to time as desired. Once blocking is initiated, the hydraulic shuttle element is continually blocked until blocking is ended and therefore timing of the deployment of the blocking device must be performed only once for each phasing operation.

Depending on the design of the CTA control valve, the first open position and the second open position of the hydraulic shuttle element may be different positions, or they may be the same position being reached by movement of the hydraulic shuttle element in either the first direction or the second direction.

Blocking of the hydraulic shuttle element is performed by deploying a blocking device comprising at least one blocking element. The blocking device is arranged in conjunction with the CTA control valve body. By this, it is meant that at least the blocking element of the blocking device must be present within the valve body when engaged, in order to restrict movement of the hydraulic shuttle element. Other components of the blocking device may be external to the valve body or internal to the valve body. The blocking device may be manufactured as a separate device to the CTA control valve or may be partially or completely integrated with the CTA control valve. For example, the blocking element and closely associated components may be integrated with the CTA control valve, while components required for actuating the blocking element may be remotely located.

Upon deployment the blocking element is moved from a position where it does not block the range of movement of the hydraulic shuttle element to a position where it engages with the shuttle element at some point in its path of movement and therefore blocks the range of movement of the hydraulic shuttle element. The blocking element may be pressure-actuated or directly actuated by solenoid and therefore the blocking device may be a hydraulic device, pneumatic device or solenoid device.

For example, if the blocking element is deployed by elevated fluid pressure, such as air pressure or oil pressure, the components of the blocking device that control the fluid pressure may be located remotely from the rotating components of the cam phaser arrangement and may instead be placed on a stationary component of the internal combustion engine such as the cam bearing holder. The fluid pressure to the blocking element may for example be regulated by an on/off solenoid valve that increases fluid pressure by connection to a source of fluid pressure, such as the main oil gallery if oil is used as the actuating fluid. Such a solenoid valve may for example be a 3-port, 2-position on/off solenoid valve being connected to an oil gallery at the inlet port, at the outlet port being connected to an oil channel leading to the blocking element, and having a vent port for release of oil pressure from the channel leading to the blocking element when in the "off" position. The solenoid valve may normally be in the "off" position when the solenoid is not actuated, and switch to the "on" position upon activation of the solenoid. The solenoid valve may be any suitable valve type known in the art, including but not limited to a poppet valve, sliding spool valve and rotary spool valve. The use of a poppet valve virtually eliminates the risk for valve jam.

An oil-filled barrel in fluid connection with the blocking element may be used as the source of fluid pressure. An on/off solenoid-actuated plunger is provided in the barrel. The solenoid-actuated piston may push down on the volume of oil in the cylinder upon actuation, leading to increased pressure at the blocking element.

The blocking device must be capable of allowing the hydraulic shuttle element to have two different ranges of motion when blocked, depending on the position of the hydraulic shuttle element when the blocking device is deployed. Therefore, the blocking device must be able to engage with at least two different positions of the hydraulic shuttle element. This may be arranged in a number of ways.

The blocking device may have two separate blocking elements, wherein the blocking device is configured to selectively deploy one or the other blocking element depending on the position of the hydraulic shuttle element during deployment. For example, the blocking device may comprise two separate lock pins together with a differential pressure interpreter that assists in selectively activating one or the other lock pin depending on the position of the hydraulic shuttle element. An example of such an embodiment is shown in FIGS. 1-2.

The blocking device may have a single blocking element that may take one of two separate blocking positions depending on the position of the hydraulic shuttle element during deployment. For example, a pivotable blocking element may be used that enters the valve housing at different positions depending on the direction of pivot.

The blocking device may comprise a single blocking element taking a single blocking position, whereby the hydraulic shuttle element should comprise two separate engagement positions to receive the blocking element. For example, the blocking element may comprise a lock pin, whereby the hydraulic shuttle element comprises two hollows configured to receive the lock pin: a first hollow allowing shuttling between the first closed position and the second open position; and a second hollow allowing shuttling between the second closed position and the first open position. By hollow is meant a hole, recess or cleft suitable for receiving a blocking element.

The oil pressure may be maintained in the cam phaser system by connection to a source of oil pressure, such as the main oil gallery. The CTA valve may be configured to be connected to a source of oil pressure. A CTA valve connected to a source of oil pressure may be configured to distribute oil between the two chambers by the shuttling movement of the hydraulic shuttle element. The channel(s) connecting to the source of oil pressure may be provided with a check valve(s) to prevent backflow of oil from the cam phaser assembly to the source of oil pressure.

The cam phaser assembly may also be provided with a number of failsafe features. For example, a pressure-actuated lock pin may be arranged in at least one of the vanes of the rotor, together with a corresponding recess in the stator for receiving the lock pin. The recess for receiving the locking pin is located at a base position, i.e. either fully advanced or fully retarded. A torsion spring may be provided in order to bias the rotor towards the base position in the event of system failure. The lock pin is normally in the deployed (locking) position, and is actuated to the retracted (unlocked) position when the pressure in a component of the cam phaser arrangement exceeds a threshold pressure. For example, the lock pin may be in fluid connection with one or more channels leading from a chamber to the CTA control valve. The lock pin may alternatively be in fluid connection with an oil refill channel.

A lock pin deploying when the pressure sinks below a threshold value may also be arranged in the CTA valve in order to lock the position of the hydraulic shuttle element relative to the valve housing. This lock-pin may for example be deployed when pressure in a fluid channel leading to the blocking element sinks below a threshold level, or when the pressure of the oil supply source sinks below a threshold level. When this lock pin is deployed, the CTA control valve may be locked in a position providing cam-torque actuated phasing in a single direction by a "hydraulic ratchet" effect, thus returning the rotor to base position by cam torque actuation. In this manner, the use of a torsion spring biasing the rotor to base position may be avoided and a greater proportion of the camshaft torque produced may be used for rotating the rotor relative to the stator.

During normal operation without cam phasing, the blocking device is not deployed and no fluid flows between the first chamber and the second chamber due to the CTA control valve acting as a double check valve. When camshaft phasing is desired, the deployment of the blocking element is timed to coincide with camshaft torque acting in the opposite direction to the desired direction of phasing. For example, if the first chamber has overpressure, the hydraulic shuttle is in the first closed position. If blocking is now initiated by deploying the blocking element, the hydraulic shuttle element will shuttle between the first closed position (during periods when the first chamber has overpressure) and the second open position (during periods when the second chamber has overpressure). The first closed position does not permit flow from the first chamber to the second chamber due to the hydraulic shuttle acting as a check valve member. The hydraulic shuttle is however prevented from acting as a check valve member in the second open position and therefore fluid may flow from the second chamber to the first. In this manner, the rotor is rotated relative to the stator and cam phasing is obtained.

The invention will now be further illustrated with reference to the figures.

FIG. 1 shows one embodiment of the disclosed variable cam timing phaser arrangement. A rotor 3 comprises at least one vane 5. The rotor is fixed to a camshaft (not shown). A stator 7 having at least one recess 9 co-axially surrounds the rotor 3. The stator is fixed to a cam sprocket (not shown). The vane 5 divides the recess 9 into a first chamber 13 and a second chamber 15. A CTA control valve 17 is arranged centrally in the rotor 3. A first oil channel 19 is arranged at the side of the vane 5 and leads from the first chamber 13 to a first port of the CTA control valve 17. A second oil channel 21 is arranged at the side of the vane 5 and leads from the second chamber 15 to a second port of the CTA control valve 17.

The CTA control valve comprises a valve body 22 having a first port 23 arranged at a first end of the valve body 22 and a second port 24 arranged at a second end of the valve body 22. A hydraulic shuttle element 25 is configured within the valve body 22. A first valve seat 27 is arranged in the valve body 22 between the first port 23 and a middle portion of the body, and a second valve seat 29 arranged in the valve body 22 between the middle portion of the body and the second port 24.

The hydraulic shuttle element 25 comprises a first disc valve member 31 arranged between the first port 23 and the first valve seat 27. The first valve member 31 is arranged to be able to form a seal with the first valve seat 27. A second disc valve member 33 is arranged between the second valve seat 29 and the second port 24. The second valve member 33 is arranged to be able to form a seal with the second valve seat 29. A valve stem 34 attaches the first disc valve member 31 to the second disc valve member 33. The valve stem 34 passes through the first valve seat 27 and second valve seat 29 and is of a length that allows the first valve member 31 and the second valve member 33 to be individually seated on their respective valve seats, though not at the same time; i.e. the stem 34 is short enough to allow the valve members 31, 33 to be seated, and long enough to ensure that both valve members 31, 33 cannot be seated simultaneously. The hydraulic shuttle element 25 is moveable by oil pressure between a first closed position whereby the first valve member 31 is seated on the first valve seat 27, and a second closed position whereby the second valve member 33 is seated on the second valve seat 29.

Two orifices 35, 36 are provided through the wall of the valve body 22 for receiving the blocking elements of a blocking device 37. The orifices 35, 36 are provided on a side of the valve body 22 that is in proximity to the blocking device 37. A first orifice 35 is arranged through the wall of the valve body in a position immediately adjacent with a face of the first valve seat 27 facing the first end of the valve body 22. A second orifice 36 is arranged through the wall of the valve body in a position immediately adjacent with a face of the second valve seat 29 facing the second end of the valve body 22.

A blocking device 37 is provided in close proximity to a side wall of the CTA control valve 17. The blocking device comprises a cylinder 39 having a first end in fluid connection with a first end of the valve body 22 by a third oil channel 47, and a second end in fluid connection with the second end of the valve body 22 by a fourth oil channel 49. The cylinder 39 and valve body 22 are aligned so that the first end of the cylinder is positioned outside and in line with the first orifice 35 of the valve body, and the second end of the cylinder is positioned outside and in line with the second orifice 36 of the valve body.

The cylinder 39 has a first orifice 40, located at the first end on a side of the cylinder 39 facing the valve body 22, and corresponding positionally to the first orifice 35 of the valve body 22. A first blocking pin 43 runs between the first orifice 40 of the cylinder 39 and the first orifice 35 of the valve body 22. The first blocking pin 43 is dimensioned suitably to be able to slide through the first orifice 35 of the valve body 22. One end of the blocking pin 43 forms a sealing engagement with the first orifice 40 of the cylinder 39, and a second end forms a sealing engagement with the first orifice 35 of the valve body 22.

The cylinder 39 has a second orifice 41, located at the second end on a side of the cylinder 39 facing the valve body 22, and corresponding positionally to the second orifice 36 of the valve body 22. A second blocking pin 45 runs between the second orifice 41 of the cylinder 39 and the second orifice 36 of the valve body 22. The second blocking pin 45 is dimensioned suitably to be able to slide through the second orifice 36 of the valve body 22. One end of the second blocking pin 45 forms a sealing engagement with the second orifice 41 of the cylinder 39, and a second end forms a sealing engagement with the second orifice 36 of the valve body 22. Thus, the first and second blocking pins prevent leakage of oil and loss of fluid pressure through orifices 35, 35, 40 and 41.

The cylinder has a third orifice 53 located at the first end of the cylinder 39, radially opposite the first orifice 40. A first end of a first actuating pin 48 forms a sealing engagement with the third orifice 53. The first actuating pin 48 is dimensioned suitably to be able to slide through the third orifice 53. The body of the first actuating pin 48 is on the outside of the cylinder 39 when the blocking device 37 is not actuated.

The cylinder has a fourth orifice 55 located at the second end of the cylinder 39, radially opposite the second orifice 41. A first end of a second actuating pin 50 forms a sealing engagement with the fourth orifice 55. The second actuating pin 50 is dimensioned suitably to be able to slide through the fourth orifice 55. The body of the second actuating pin 50 is on the outside of the cylinder 39 when the blocking device 37 is not actuated.

A piston 51 is arranged in the cylinder 39 and is moveable by fluid pressure between a first position and a second position in response to fluid pressure. The first position is at the second end of the cylinder 39, in between the second blocking pin 45 and the second actuating pin 50. The second position is at the first end of the cylinder 39, in between the first blocking pin 43 and the first actuating pin 48. The piston 51 is dimensioned to be able to fit through the orifices 40 and 41 in order to displace blocking pins 43 and 45 into the valve body 22 whenever the blocking device 37 is actuated.

Figure 2A:
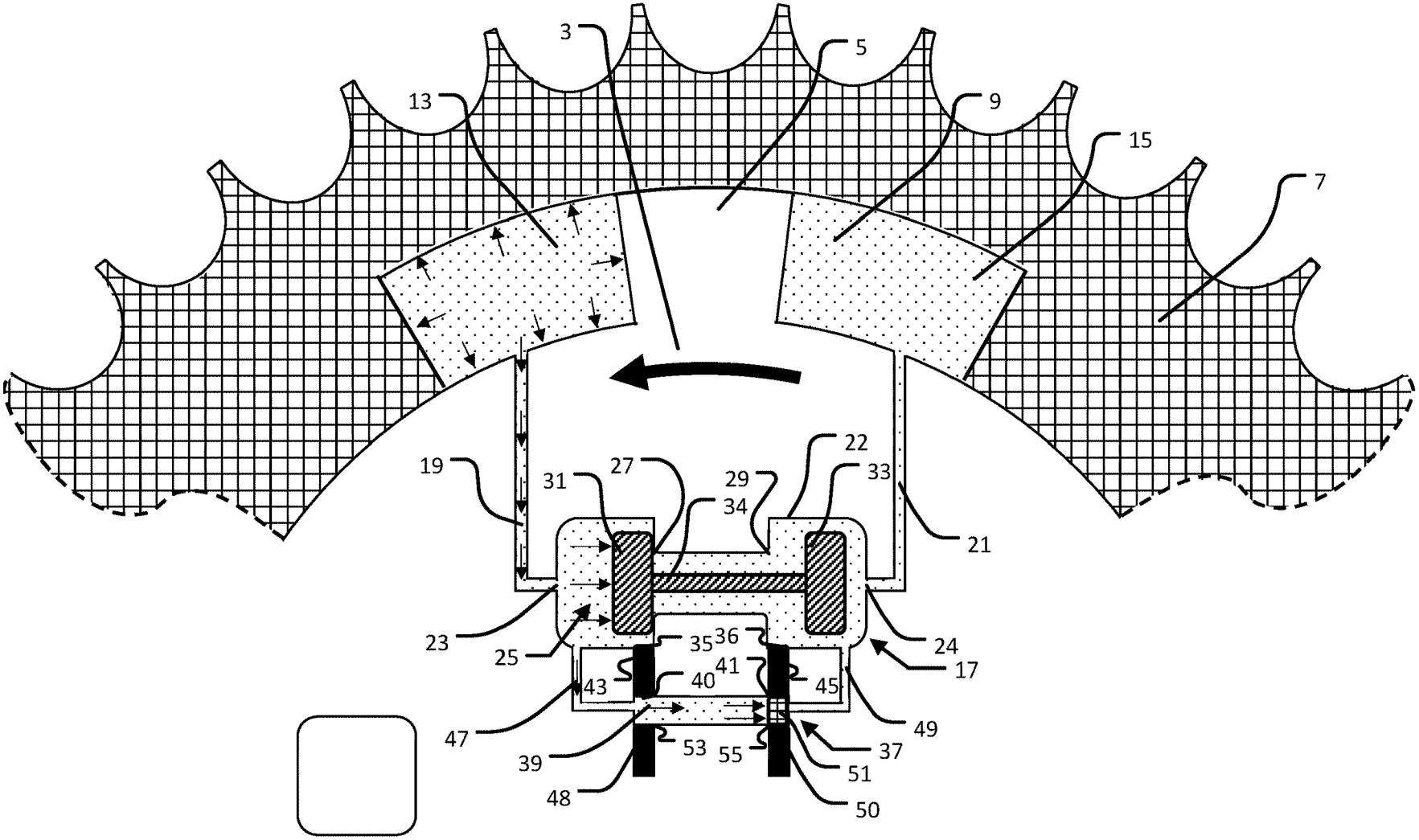
FIG. 2*a* illustrates schematically one embodiment of a variable cam timing phaser arrangement in a first closed state.
Figure 2B:
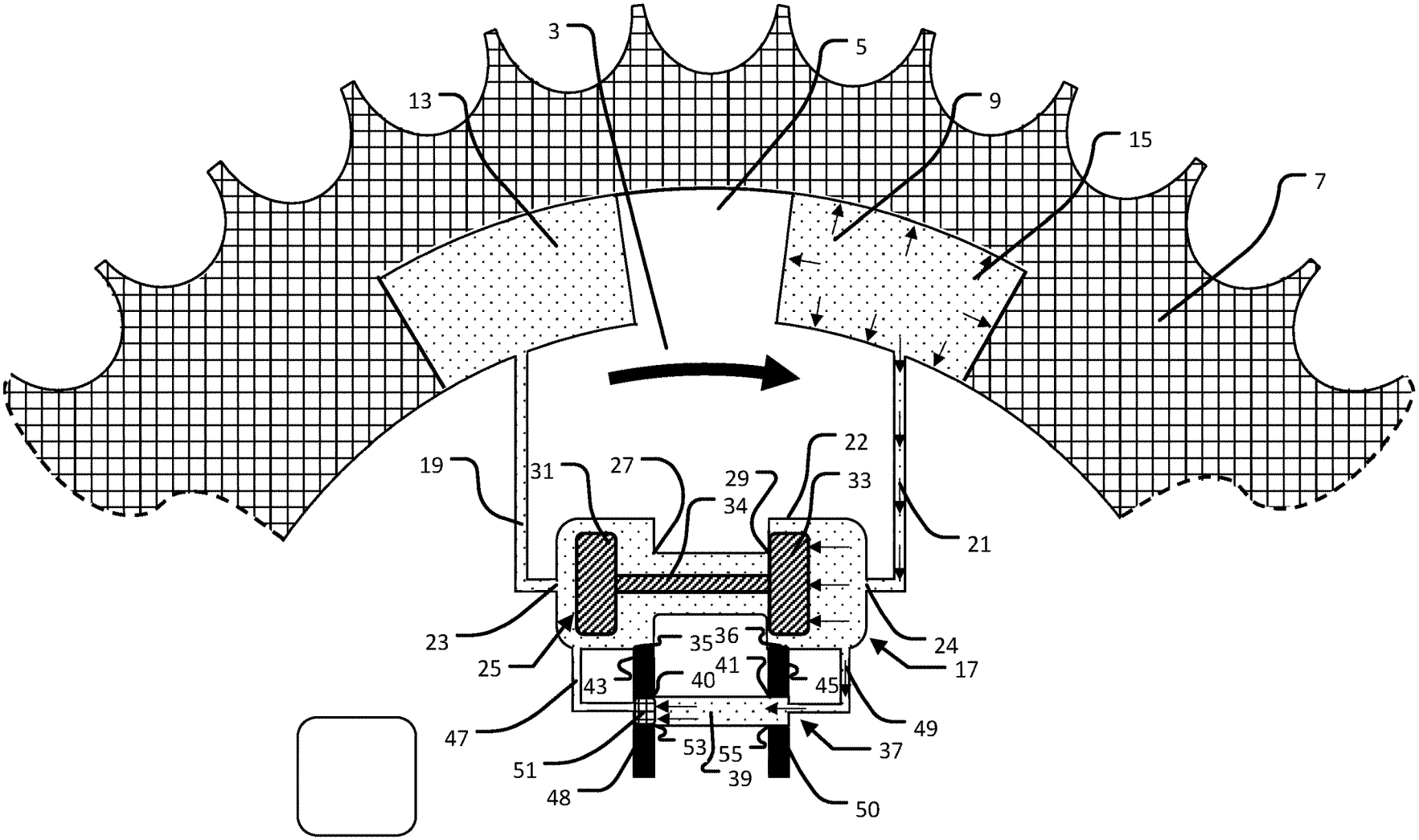
FIG. 2*b* illustrates schematically one embodiment of a variable cam timing phaser arrangement in a second closed state.

The cam timing phaser arrangement functions as follows. Whenever oil pressure is higher in the first chamber 13 than in the second chamber 15, the hydraulic shuttle element 25 is moved by fluid pressure to the first closed position, whereby the first valve member 31 is seated on the first valve seat 27 and flow is prevented from the first chamber 13 to the second chamber 15. At the same time, piston 51 is moved by fluid pressure to the first position (at the second end of the cylinder 39). This first closed state of the cam phaser arrangement is shown in FIG. 2*a*. Whenever oil pressure is higher in the second chamber 15 than in the first chamber 13, the hydraulic shuttle element 25 is moved to the second closed position, whereby the second valve member 33 is seated on the second valve seat 29 and flow is prevented from the second chamber 15 to the first chamber 13. At the same time, piston 51 is moved by fluid pressure to the second position (at the first end of the cylinder 39). This second closed state of the cam phaser arrangement is shown in FIG. 2*b*. Thus, when unactuated, the control assembly prevents flow in both directions, i.e. is in a cam phase holding mode. Note however that the hydraulic shuttle element 25 and piston 51 each take two separate positions, depending on the direction that the pressure difference that the two chambers 13, 15 works in. This feature is exploited to provide phasing in the desired direction.

Figure 2C:
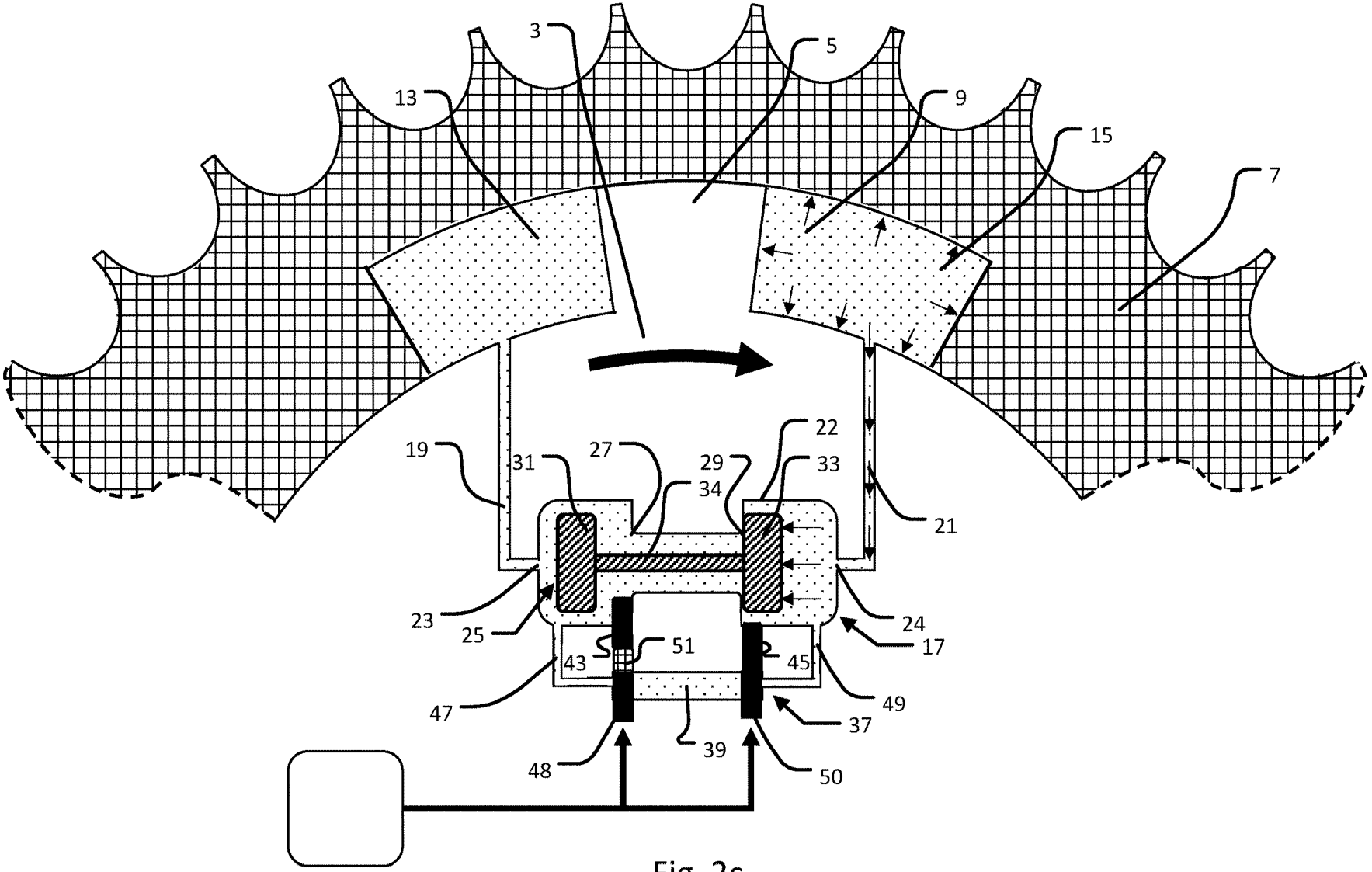
FIG. 2*c* illustrates schematically one embodiment of a variable cam timing phaser arrangement when a blocking device is activated during a second closed state.
Figure 2D:
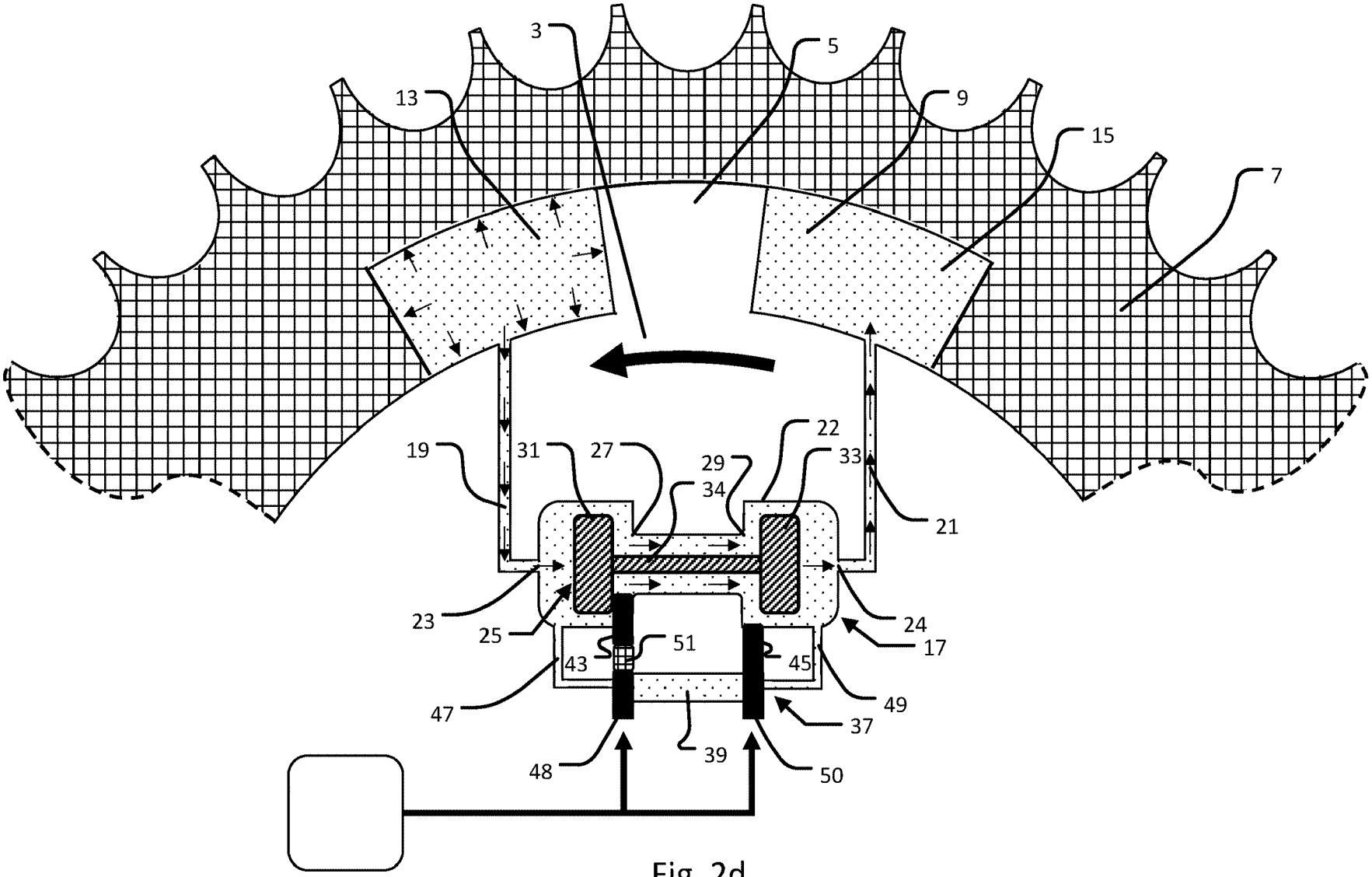
FIG. 2*d* illustrates schematically one embodiment of a variable cam timing phaser arrangement in a first open state.

If phasing is desired in a first direction, i.e. fluid flow is desired from the first chamber to the second chamber, the blocking device 37 is deployed during a period when the second chamber has overpressure. Thus, the hydraulic shuttle element 25 is in the second position, and the piston 51 is in the second position. When the blocking device is deployed, the actuating pins 48, 50 are moved into the cylinder 39 by an actuating force. This actuating force may be fluid pressure or a force provided by the movement of a solenoid. The piston, being in the second position, is pressed by the first actuation pin 48 through the first cylinder orifice 40. The piston in turn pushes the first blocking pin 43 through the first valve body orifice 35 into the inner volume of the valve body. At the opposite end of the cylinder, the second actuation pin 50 moves into the cylinder volume. However, this motion is not transmitted further to the blocking pin 45 since the piston 51 is not in the relevant position between the pins 50, 45. Thus the first blocking pin 43 is moved to an engaged position within the inner volume of the valve body 22, and the second blocking pin 45 is not engaged. This is shown In FIG. 2*c*. When the camshaft torque now fluctuates so that pressure acts in the opposite direction and the first chamber 13 has overpressure, the hydraulic shuttle element 25 is blocked by the engaged first blocking element 43 from moving to the first closed position and forming a seal with first valve member 27. This is shown in FIG. 2*d*. Instead, the hydraulic shuttle element is limited to moving to a first open position, allowing fluid to flow from the first chamber 13 to the second chamber 15 via the CTA control valve 17. The hydraulic shuttle element will alternate between being in the first open position and the second closed position until the actuating force is removed from the actuating pins 48, 50 whereby the blocking pins 43, 45 and actuating pins 48, 50 will return to their non-actuated state, the piston 51 will be returned to the cylinder 39, and the cam phaser will return to its non-actuated, cam phasing holding state.

Phasing is obtained in an analogous manner in the opposite direction by deploying the blocking device when the hydraulic shuttle element 25 is in the first closed position.

Figure 3:
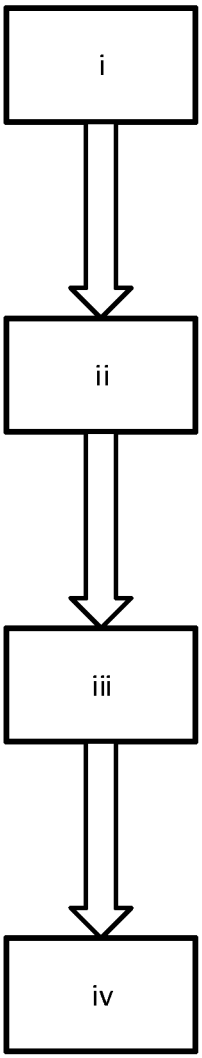
FIG. 3 shows a process flow diagram for a method for controlling the timing of a camshaft in an internal combustion engine according to the present disclosure.

FIG. 3 shows a process flow diagram for a method of controlling the timing of a camshaft in an internal combustion engine comprising a variable cam timing phaser arrangement as disclosed.

In a first step, the cam timing phaser arrangement is provided having the blocking device in a disengaged position, thereby preventing fluid communication between the first chamber and the second chamber; i.e. the cam phaser arrangement is initially in a cam phasing holding state.

In a second step, the blocking device is deployed to coincide with the fluid pressure acting in the opposite direction to the direction of phasing desired. This means that a blocking element will be moved to the engaged position to limit further movement of the hydraulic shuttle element of the CTA valve.

In a third step, the deployment of the blocking device is maintained. During this time, the fluctuating camshaft torque will lead to alternating pressure peaks in the first and second chambers, and the CTA control valve will allow fluid flow in a single direction, thus attaining directional flow from one chamber to the other.

In a fourth step, the blocking device is disengaged once the desired degree of camshaft phasing is obtained. By disengaging the blocking device, the cam timing phaser arrangement is returned to the holding state.

Figure 4:
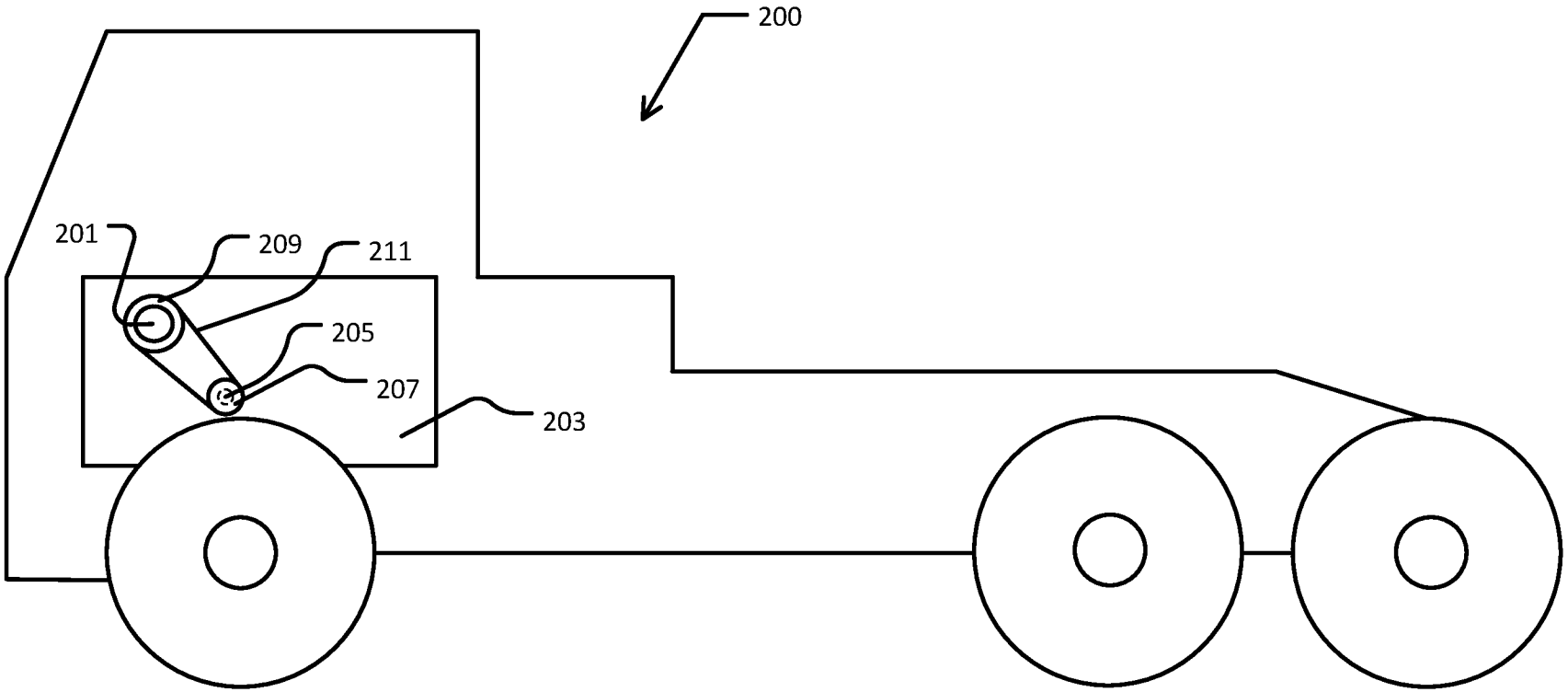
FIG. 4 illustrates schematically a vehicle comprising an internal combustion engine comprising a variable cam timing phaser arrangement according to the present disclosure.

The present invention also relates to an internal combustion engine and a vehicle comprising a variable cam timing phaser arrangement as described above. FIG. 4 shows schematically a heavy goods vehicle 200 having an internal combustion engine 203. The internal combustion engine has a crankshaft 205, crankshaft sprocket 207, camshaft (not shown), camshaft sprocket 209 and timing chain 211. The variable cam timing phaser arrangement 201 is located at the rotational axis of the cam sprocket/camshaft. An engine provided with such a variable cam timing phaser arrangement has a number of advantages such as better fuel economy, lower emissions and better performance as compared to a vehicle lacking cam phasing.

The invention claimed is:

1. A variable cam timing phaser arrangement for an internal combustion engine, said variable cam timing phaser arrangement comprising:

a rotor having at least one vane, the rotor arranged to be connected to a camshaft;

a stator co-axially surrounding the rotor, the stator having at least one recess configured to receive the at least one vane of the rotor and allowing rotational movement of the rotor with respect to the stator, the stator having an outer circumference arranged for accepting a drive force;

wherein the at least one vane divides the at least one recess of the stator into a first chamber and a second chamber, the first chamber and the second chamber being arranged to receive hydraulic fluid under pressure, wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction of the rotor being in an opposite direction from the first rotational direction of the rotor; and a control assembly configured to regulate hydraulic fluid flow between the first chamber and the second chamber, wherein the control assembly comprises:

a cam torque actuation (CTA) control valve located centrally within the rotor and/or camshaft, the CTA control valve comprising a valve body having a first port arranged in fluid communication with the first chamber, a second port arranged in fluid communication with the second chamber, and a hydraulic shuttle element arranged in the valve body; and a blocking device arranged in conjunction with the valve body, wherein the hydraulic shuttle element is configured to be moved in a first direction to a first closed position by overpressure in the first chamber and moved in a second direction to a second closed position by overpressure in the second chamber, whereby in the first closed position, the hydraulic shuttle element forms a seal together with an inner wall of the valve body or a first valve seat located in the valve body, thereby preventing fluid flow from the first chamber to the second chamber, and whereby in the second closed position the hydraulic shuttle element forms a seal together with the inner wall of the valve body or a second valve seat located in the valve body, thereby preventing fluid flow from the second chamber to the first chamber, and wherein the blocking device comprises at least one blocking element that is selectively deployed between a disengaged position and an engaged position, wherein the at least one blocking element is, in the engaged position, configured to prevent the hydraulic shuttle element from moving to the first closed position from the second closed position or to the second closed position from the first closed position, depending on a current position of the hydraulic shuttle element, when the blocking device is deployed, whereby the hydraulic shuttle element is configured to move between the first closed position in response to overpressure in the first chamber and a second open position in response to overpressure in the second chamber, or between the second closed position in response to overpressure in the second chamber and a first open position in response to overpressure in the first chamber;

whereby in the second open position, the hydraulic shuttle element allows fluid flow from the second chamber to the first chamber, and whereby in the first open position, the hydraulic shuttle element allows fluid flow from the first chamber to the second chamber.

2. A variable cam timing phaser arrangement according to claim 1, wherein the hydraulic shuttle element is arranged to move by translational motion along a longitudinal axis of the valve body in response to pressure differences between the first chamber and the second chamber.

3. A variable cam timing phaser arrangement according to claim 1, wherein the first port is arranged at a first end of the valve body and the second port is arranged at a second end of the valve body, wherein the first valve seat is arranged in the valve body between the first end of the valve body and a middle portion of the body, and the second valve seat is arranged in the valve body between the middle portion of the body and the second end; and a first valve member arranged between the first end and the first valve seat, and arranged to form a seal with the first valve seat, a second valve member arranged between the second valve seat and the second end of the valve body and arranged to form a seal with the second valve seat, and a valve stem passing through the first valve seat and second valve seat and arranged to attach the first valve member to the second valve member, wherein the valve stem has a length such that when the first valve member forms a seal with the first valve seat, the second valve member cannot be seated on the second valve seat, and when the second valve member forms a seal with the second valve seat, the first valve member cannot be seated on the first valve seat.

4. A variable cam timing phaser arrangement according to claim 1, wherein the blocking device further comprises:

a cylinder having a first end in fluid communication with the first chamber and a second end in fluid communication with the second chamber; and a cylinder member arranged in the cylinder and configured to be moved along a longitudinal axis of the cylinder between a first cylinder position, by fluid pressure, whenever the hydraulic shuttle element is in the first closed position, and a second cylinder position, by fluid pressure, whenever the hydraulic shuttle element is in the second closed position, wherein the cylinder member is arranged to be moved in a radial direction relative to the longitudinal axis of the cylinder when in the first cylinder position or second cylinder position, whenever the blocking device is deployed, wherein the at least one blocking element comprises a first blocking element configured to be moved to a first engaged position by a radial motion of the cylinder member whenever the blocking device is deployed with the cylinder member in the second cylinder position, wherein the first engaged position of the first blocking element blocks the hydraulic shuttle element from attaining the first closed position, and wherein the at least one blocking element comprises a second blocking element configured to be moved to a second engaged position by the radial motion of the cylinder member whenever the blocking device is deployed with the cylinder member in the first cylinder position, wherein the second engaged position of the second blocking element blocks the hydraulic shuttle element from attaining the second closed position.

5. A variable cam timing phaser arrangement according to claim 1, wherein the hydraulic shuttle element is arranged to move by rotational motion around a central rotational axis of the valve body in response to pressure differences between the first chamber and the second chamber.

6. A variable cam timing phaser arrangement according to claim 1, wherein the hydraulic shuttle element comprises two or more hollows arranged to receive the at least one blocking element when the at least one blocking element is in the engaged position.

7. A variable cam timing phaser arrangement according to claim 1, wherein the at least one blocking element is deployed by one of: increased external hydraulic pressure, increased external pneumatic pressure, or energization of a solenoid.

8. A variable cam timing phaser arrangement according to claim 7, wherein the at least one blocking element is deployed by increased external hydraulic pressure and the external hydraulic pressure is regulated by a solenoid-controlled actuator.

9. A variable cam timing phaser arrangement according claim 8, wherein the solenoid-controlled actuator is a 3/2 way on/off solenoid valve having an inlet port in fluid communication with a source of increased fluid pressure, an outlet port in fluid communication with the blocking device, and a vent port, wherein a primary state of the solenoid valve is a de-energized state preventing fluid communication from the source of increased fluid pressure to the blocking device and allowing fluid communication from the blocking device to the vent port, and wherein a secondary state of the solenoid valve is an energized state allowing fluid communication from the source of increased fluid pressure to the blocking device and deploying the at least one blocking element.

10. A variable cam timing phaser arrangement according to claim 8, wherein the solenoid-controlled actuator comprises a solenoid-driven plunger arranged in a barrel, the barrel being arranged in fluid communication with the blocking device, wherein a primary state of the solenoid-driven plunger is a retracted de-energized state and a secondary state of the solenoid-driven plunger is an extended energized state, the extended energized state causing the increased external hydraulic pressure.

11. A variable cam timing phaser arrangement according to claim 1, wherein a source of increased fluid pressure is arranged in fluid communication with the first chamber and/or the second chamber via a refill channel.

12. A variable cam timing phaser arrangement according to claim 1, wherein the hydraulic fluid is hydraulic oil.

13. A method for controlling a timing of a camshaft in an internal combustion engine comprising a variable cam timing phaser arrangement comprising:

a rotor having at least one vane, the rotor arranged to be connected to a camshaft;

a stator co-axially surrounding the rotor, the stator having at least one recess configured to receive the at least one vane of the rotor and allowing rotational movement of the rotor with respect to the stator, the stator having an outer circumference arranged for accepting a drive force;

wherein the at least one vane divides the at least one recess of the stator into a first chamber and a second chamber, the first chamber and the second chamber being arranged to receive hydraulic fluid under pressure, wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction of the rotor being in an opposite direction from the first rotational direction of the rotor; and a control assembly configured to regulate hydraulic fluid flow between the first chamber and the second chamber, wherein the control assembly comprises:

a cam torque actuation (CTA) control valve located centrally within the rotor and/or camshaft, the CTA control valve comprising a valve body having a first port arranged in fluid communication with the first chamber, a second port arranged in fluid communication with the second chamber, and a hydraulic shuttle element arranged in the valve body; and a blocking device arranged in conjunction with the valve body, wherein the hydraulic shuttle element is configured to be moved in a first direction to a first closed position by overpressure in the first chamber and moved in a second direction to a second closed position by overpressure in the second chamber, whereby in the first closed position, the hydraulic shuttle element forms a seal together with an inner wall of the valve body or a first valve seat located in the valve body, thereby preventing fluid flow from the first chamber to the second chamber, and whereby in the second closed position the hydraulic shuttle element forms a seal together with the inner wall of the valve body or a second valve seat located in the valve body, thereby preventing fluid flow from the second chamber to the first chamber, and wherein the blocking device comprises at least one blocking element that is selectively deployed between a disengaged position and an engaged position, wherein the at least one blocking element is, in the engaged position, configured to prevent the hydraulic shuttle element from moving to the first closed position from the second closed position or to the second closed position from the first closed position, depending on a current position of the hydraulic shuttle element, when the blocking device is deployed, whereby the hydraulic shuttle element is configured to move between the first closed position in response to overpressure in the first chamber and a second open position in response to overpressure in the second chamber, or between the second closed position in response to overpressure in the second chamber and a first open position in response to overpressure in the first chamber;

whereby in the second open position, the hydraulic shuttle element allows fluid flow from the second chamber to the first chamber, and whereby in the first open position, the hydraulic shuttle element allows fluid flow from the first chamber to the second chamber, the method comprising:

i. providing the blocking device in the disengaged position, thereby preventing fluid communication between the first chamber and the second chamber;

ii. deploying the blocking device at a time coinciding with the hydraulic shuttle element being in the first closed position thereby engaging the at least one blocking element so as to block the hydraulic shuttle element from moving to the second closed position; or deploying the blocking device at a time coinciding with the hydraulic shuttle element being in the second closed position thereby engaging the at least one blocking element so as to block the hydraulic shuttle element from moving to the first closed position;

iii. maintaining the deployment of the blocking device thereby allowing fluid to periodically flow in a single direction between the first chamber and the second chamber due to camshaft torque, and preventing fluid flow in an opposite direction, thus rotating the rotor relative to the stator; and iv. once a target rotation of the rotor relative to the stator is obtained, disengaging the blocking device, thereby preventing further fluid communication between the first chamber and the second chamber.

14. An internal combustion engine comprising a variable cam timing phaser arrangement comprising:

a rotor having at least one vane, the rotor arranged to be connected to a camshaft;

a stator co-axially surrounding the rotor, the stator having at least one recess configured to receive the at least one vane of the rotor and allowing rotational movement of the rotor with respect to the stator, the stator having an outer circumference arranged for accepting a drive force;

wherein the at least one vane divides the at least one recess of the stator into a first chamber and a second chamber, the first chamber and the second chamber being arranged to receive hydraulic fluid under pressure, wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction of the rotor being in an opposite direction from the first rotational direction of the rotor; and a control assembly configured to regulate hydraulic fluid flow between the first chamber and the second chamber, wherein the control assembly comprises:

a cam torque actuation (CTA) control valve located centrally within the rotor and/or camshaft, the CTA control valve comprising a valve body having a first port arranged in fluid communication with the first chamber, a second port arranged in fluid communication with the second chamber, and a hydraulic shuttle element arranged in the valve body; and a blocking device arranged in conjunction with the valve body, wherein the hydraulic shuttle element is configured to be moved in a first direction to a first closed position by overpressure in the first chamber and moved in a second direction to a second closed position by overpressure in the second chamber, whereby in the first closed position, the hydraulic shuttle element forms a seal together with an inner wall of the valve body or a first valve seat located in the valve body, thereby preventing fluid flow from the first chamber to the second chamber, and whereby in the second closed position the hydraulic shuttle element forms a seal together with the inner wall of the valve body or a second valve seat located in the valve body, thereby preventing fluid flow from the second chamber to the first chamber, and wherein the blocking device comprises at least one blocking element that is selectively deployed between a disengaged position and an engaged position, wherein the at least one blocking element is, in the engaged position, configured to prevent the hydraulic shuttle element from moving to the first closed position from the second closed position or to the second closed position from the first closed position, depending on a current position of the hydraulic shuttle element, when the blocking device is deployed, whereby the hydraulic shuttle element is configured to move between the first closed position in response to overpressure in the first chamber and a second open position in response to overpressure in the second chamber, or between the second closed position in response to overpressure in the second chamber and a first open position in response to overpressure in the first chamber;

whereby in the second open position, the hydraulic shuttle element allows fluid flow from the second chamber to the first chamber, and whereby in the first open position, the hydraulic shuttle element allows fluid flow from the first chamber to the second chamber.

15. A vehicle comprising a variable cam timing phaser arrangement comprising:

a rotor having at least one vane, the rotor arranged to be connected to a camshaft;

a stator co-axially surrounding the rotor, the stator having at least one recess configured to receive the at least one vane of the rotor and allowing rotational movement of the rotor with respect to the stator, the stator having an outer circumference arranged for accepting a drive force;

wherein the at least one vane divides the at least one recess of the stator into a first chamber and a second chamber, the first chamber and the second chamber being arranged to receive hydraulic fluid under pressure, wherein introduction of hydraulic fluid into the first chamber causes the rotor to move in a first rotational direction relative to the stator and introduction of hydraulic fluid into the second chamber causes the rotor to move in a second rotational direction relative to the stator, the second rotational direction of the rotor being in an opposite direction from the first rotational direction of the rotor; and a control assembly configured to regulate hydraulic fluid flow between the first chamber and the second chamber, wherein the control assembly comprises:

a cam torque actuation (CTA) control valve located centrally within the rotor and/or camshaft, the CTA control valve comprising a valve body having a first port arranged in fluid communication with the first chamber, a second port arranged in fluid communication with the second chamber, and a hydraulic shuttle element arranged in the valve body; and a blocking device arranged in conjunction with the valve body, wherein the hydraulic shuttle element is configured to be moved in a first direction to a first closed position by overpressure in the first chamber and moved in a second direction to a second closed position by overpressure in the second chamber, whereby in the first closed position, the hydraulic shuttle element forms a seal together with an inner wall of the valve body or a first valve seat located in the valve body, thereby preventing fluid flow from the first chamber to the second chamber, and whereby in the second closed position the hydraulic shuttle element forms a seal together with the inner wall of the valve body or a second valve seat located in the valve body, thereby preventing fluid flow from the second chamber to the first chamber, and wherein the blocking device comprises at least one blocking element that is selectively deployed between a disengaged position and an engaged position, wherein the at least one blocking element is, in the engaged position, configured to prevent the hydraulic shuttle element from moving to the first closed position from the second closed position or to the second closed position from the first closed position, depending on a current position of the hydraulic shuttle element when the blocking device is deployed, whereby the hydraulic shuttle element is configured to move between the first closed position in response to overpressure in the first chamber and a second open position in response to overpressure in the second chamber, or between the second closed position in response to overpressure in the second chamber and a first open position in response to overpressure in the first chamber;

whereby in the second open position, the hydraulic shuttle element allows fluid flow from the second chamber to the first chamber, and whereby in the first open position, the hydraulic shuttle element allows fluid flow from the first chamber to the second chamber.

* * * * *